US007896104B2

(12) United States Patent
Becker et al.

(10) Patent No.: US 7,896,104 B2
(45) Date of Patent: Mar. 1, 2011

(54) DEVICE AND METHOD FOR EXPLOSIVE DRILLING

(75) Inventors: Claus Willi Becker, Nordhausen (DE); Bernhard Werner Schwark-Werwach, Hamburg (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 279 days.

(21) Appl. No.: 12/149,753

(22) Filed: May 7, 2008

(65) Prior Publication Data

US 2010/0032206 A1 Feb. 11, 2010

(30) Foreign Application Priority Data

May 10, 2007 (EP) ..... 07009413

(51) Int. Cl.
*E21B 7/00* (2006.01)

(52) U.S. Cl. ..... 175/3.5; 166/63; 175/4.5; 175/4.57

(58) Field of Classification Search ..... 175/424, 175/3.5, 4.5, 4.57, 2; 102/313, 315, 320, 102/321.1, 326; 89/1.13, 1.15, 1.151; 181/106, 181/117; 149/109.6; 166/299, 63
See application file for complete search history.

(56) References Cited

U.S. PATENT DOCUMENTS

| | | | | | |
|---|---|---|---|---|---|
| 2,704,514 | A | | 11/1938 | Barlow et al. | |
| 3,130,797 | A | * | 4/1964 | Johnson | 175/4.5 |
| 3,516,502 | A | * | 6/1970 | Bennett et al. | 175/4.5 |
| 3,548,957 | A | * | 12/1970 | Schegolevsky | 175/4.5 |
| 3,605,918 | A | | 9/1971 | Bennett | |
| 3,792,752 | A | * | 2/1974 | Knox et al. | 181/117 |
| 4,369,689 | A | * | 1/1983 | Donaghue et al. | 86/20.15 |
| 5,920,030 | A | * | 7/1999 | Day | 102/313 |
| 5,996,709 | A | * | 12/1999 | Norris | 175/4.5 |

FOREIGN PATENT DOCUMENTS

| | | |
|---|---|---|
| FR | 1581755 | 10/1970 |
| GB | 1194493 | 9/1969 |
| GB | 603 045 | 6/1970 |
| SU | 121390 | 8/1946 |

* cited by examiner

*Primary Examiner*—Daniel P Stephenson
*Assistant Examiner*—Cathleen R Hutchins
(74) *Attorney, Agent, or Firm*—Jacobson Holman PLLC

(57) ABSTRACT

The invention relates to a device and a method for explosive drilling. Explosive capsules are fired by a firing device at a material to be stripped. A high degree of safety is attained in that use is made of an explosive with liquid oxygen that is only produced immediately before its application.

23 Claims, 4 Drawing Sheets

DEVICE AND METHOD FOR EXPLOSIVE DRILLING

BACKGROUND OF THE INVENTION

1. Field of the Invention

The invention relates to a device for explosive drilling by means of explosive capsules with a firing device for firing the explosive capsules at a material to be stripped, wherein at least one container with liquid oxygen and at least one container with at least one fuel component are provided.

The invention further relates to a method for explosive drilling.

2. Description of Related Art Including Information Disclosed Under 37 CFR §§1.97 and 37 CFR 1.98

Devices and methods of this kind that are used for the explosive drilling of earth or rock formations have been known for a long time, as for example from U.S. Pat. No. 3,516,502 or from U.S. Pat. No. 3,605,918. Especially when boreholes are sunk in hard rock formations, such as granite, the specific application of explosive capsules for shattering the rock leads to excellent stripping performances.

However, up to now explosive drilling could not gain ground within a wide range of applications. One of the reasons for this can be found in particular in the extremely strict legal regulations concerning the transport, storage and use of explosives. Especially in the civil sectors these extremely rigorous restrictions for explosives stood in the way of an economic application of explosive drilling.

BRIEF SUMMARY OF THE INVENTION

The invention is based on the object to provide a device and a method for explosive drilling, with which a safe and economic application of explosive drilling is rendered possible in a great variety of applications.

In accordance with the invention the object is solved on the one hand by a device in which a combining device is arranged for combining the fuel component with the liquid oxygen for the forming of the explosive capsules and a supply device is provided for supplying the formed explosive capsules to the firing device, and on the other hand by a method wherein an explosive with liquid oxygen is used.

The device for explosive drilling according to the invention is characterized in that at least one container with liquid oxygen and at least one container with at least one fuel component are provided, in that a combining device is arranged for combining the fuel component with the liquid oxygen for the forming of the explosive capsules and in that a supply device is provided for supplying the formed explosive capsules to the firing device.

A fundamental idea of the invention resides in the fact that the explosive capsules used for explosive drilling are produced immediately before their application directly on the device. Thereby, for the production of the explosive capsules components are employed that are as such practically non-hazardous, in particular they are not considered as explosives and do not fall under any legal restrictions.

According to a finding of the invention liquid oxygen explosives are especially suitable for this purpose. Explosives containing liquid oxygen have been known for many decades. Cryogenic liquid oxygen is a particularly strong oxidizing agent, which, on being mixed appropriately, leads to an explosive-like reaction even with low-reactive fuels.

From U.S. Pat. No. 1,508,185 a liquid oxygen explosive containing wood powder as a fuel is known for example. However, as fuel other types of compounds containing carbon, hydrocarbon, other organic compounds and even metal powder and other substances can also be used, which, when reacting with oxygen, have a sufficient exothermal reaction enthalpy. A mixing of these fuels, which are present in particular in a solid state, preferably in a powdery or loose state, with liquid oxygen leads to an almost optimal spatial arrangement of the reactants, so that a rapid combustion and therefore a detonating reaction is brought about. In particular, according to the invention fuels on the basis of hydrocarbon molecules are used which, by being free of any safety-related restrictions, can be transported and stored in any chosen quantity. Likewise, liquid oxygen is a widespread technical gas that is used on a large scale in the welding technique for example and can be acquired without problem via existing distribution systems.

For safe application in explosive drilling the use of liquid oxygen explosives according to the invention offers the additional advantage that under ambient conditions these explosives keep their explosive properties for a short period of time only, ranging approximately from some seconds up to a few minutes. The reason is that cryogenic liquid oxygen volatilizes very quickly so that the remaining fuel component regains its normal non-hazardous state. More particularly, the fuel component is also environmentally friendly so that even in the case of an unintended non-detonation no hazardous material with regard to both explosive properties and environmental compatibility remains in the ground.

From these freely available and generally non-hazardous basic components explosive capsules are produced in the machine according to the invention, which are then directly fired via a supply device at the material to be shattered, in particular at rock formations.

An advantageous embodiment of the device according to the invention resides in the fact that in the combining device the fuel component is present as a prefabricated shaped body or can be formed into shaped bodies, in which case the fuel component can be mixed with the liquid oxygen before or after the forming. The fuel component, which is preferably existent as a powder or granulated material, is formed e.g. through sintering or pressing into a desired shape. In particular, this shape can be cylindrical or substantially spherical, while special shapes, e.g. for forming a hollow charge, are possible, too. Following the formation, the shaped body consisting of the fuel component is preferably soaked with the liquid oxygen and is thereby activated. The explosive capsule thus produced can then be supplied directly to the firing device, by means of which the explosive capsules can be fired in a defined direction and with a defined energy at the rock to be stripped. When sinking predominantly vertically directed boreholes an acceleration of the explosive capsules can take place solely through gravity so that the firing device merely releases or deblocks the explosive capsules.

Another preferred embodiment of the invention resides in the fact that casing bodies, prefabricated capsules containing fuel, and/or ignition elements can be supplied to the combining device in order to form the explosive capsules. If the fuel components as such do not possess inherent stability, the components can also be filled into a casing body made for example of cardboard or metal. This casing body serves as a geometric mold or shape-giver for the explosive charge. Especially when use is made of casing bodies a desired increase in the detonation effect can be additionally adjusted. There is also the possibility of filling the fuel component together with the liquid oxygen as a kind of slurry into the casing bodies. In the following the bodies consisting of the explosive charges that are filled into the casing or shaped bodies shall also be referred to as explosive capsules. Basically, the explosive capsule can explode as a result of the impact, pressure or blow energy occurring during the impact on the rock to be shattered. However, to increase safety it may be useful to arrange also an ignition device in the capsule, such as a conventional impact igniter. For example in the explosive capsules a dynamic inertia plugging can be provided in the rear part as seen in the impact direction, which triggers the detonating reaction at the moment of impact and/or preferably enhances the effect of detonation in the forward direction.

For the production of boreholes it is particularly preferred according to the invention that a tube-shaped drilling body is provided, in the lower end portion of which at least one aperture of the firing device is arranged. This allows for the most precise application as possible of the explosive capsules onto the material to be stripped. It can be provided one central aperture or several apertures that are spaced from the drilling axis. In addition, it is possible to provide a drill head with a rotatable or pivotable aperture.

According to the invention a directional control or a control of the drilling progress can be implemented in that, depending on the angle of rotation of the drill head, that part of the working face is preferably fired at, into which the borehole is to be redirected. To this end the firing aperture can be arranged eccentrically to the drilling axis. In addition, an adjusting device for adjusting the aperture can be provided.

Furthermore, according to the invention a gas nozzle arrangement is designed in the vicinity of the aperture. The nozzle arrangement can in particular be a ring nozzle arrangement around the aperture. This can serve to stabilize the trajectory of the explosive capsule, in which case the trajectory can have a length ranging from a few centimeters to some meters. In addition, in the case of works carried out in suspension-filled boreholes via the gas nozzle arrangement can be created a free space for the explosive capsule in the suspension.

According to the invention an especially good stripping performance is achieved in that in the lower end portion of the drilling body stripping members, in particular cutting teeth and/or roller bits are arranged. With these stripping members shattered or partly loosened rock material can be stripped. The combination of explosive shattering and stripping of the rock by means of stripping members brings about a borehole having a wall with the precise shape.

Furthermore, according to the invention a discharging conveyor device, in particular an auger, is arranged for conveying away the material to be shattered. The auger can be arranged in a flight-shaped manner around the tubular drilling body, which is driven in a rotating manner by a rotary drive. Alternatively, the discharging the conveyor device can also comprise an air supply, whereby stripped soil material can be conveyed away from the borehole in the airlift method.

Basically, the firing device can comprise a mechanical, electromechanical or even an explosion system. In accordance with the invention an especially simple and practicable design resides in the fact that the firing device has a pneumatic or hydraulic feeding device. The feeding device can be connected to a compressed-air supply by which a flow of compressed air can be generated. By means of this compressed-air-flow explosive capsules can be pneumatically accelerated and fed individually or in a continuous manner in a tube for example. They are fired with a defined kinetic energy and in a defined direction at the material which is to be stripped.

The method for explosive drilling according to the invention is characterized in that an explosive with liquid oxygen is used. As a result, the previously described advantages are attained in explosive drilling with regard to safety and good environmental compatibility.

An especially high safety level is attained in accordance with the invention in that explosive capsules are formed of at least one fuel and the liquid oxygen immediately before being supplied to a firing device and in that the explosive capsules are fired by the firing device at a material to be stripped in order to explode thereon and shatter the material. In this method according to the invention the explosive is produced according to demand directly before being fired so that a storage of large quantities of the explosive in its potentially explosive state is not required.

In accordance with the invention a very good stripping performance is achieved in that the explosive capsule is fired with a frequency of 0.1 Hz to 500 Hz. Hence, depending on the firing frequency relatively small explosive capsules with a few grams of explosive material can be used which, in themselves, represent a very small danger potential only. As a result, the easy and safe application of explosive drilling according to the invention is increased further.

In accordance with the invention it is particularly preferred that an afore-described device is employed for explosive drilling.

BRIEF DESCRIPTION OF THE SEVERAL VIEWS OF THE DRAWINGS

In the following the invention will be described further by way of preferred embodiments shown in an extremely schematized manner in the accompanying drawings, wherein.

DETAILED DESCRIPTION OF THE INVENTION

Figure 1:
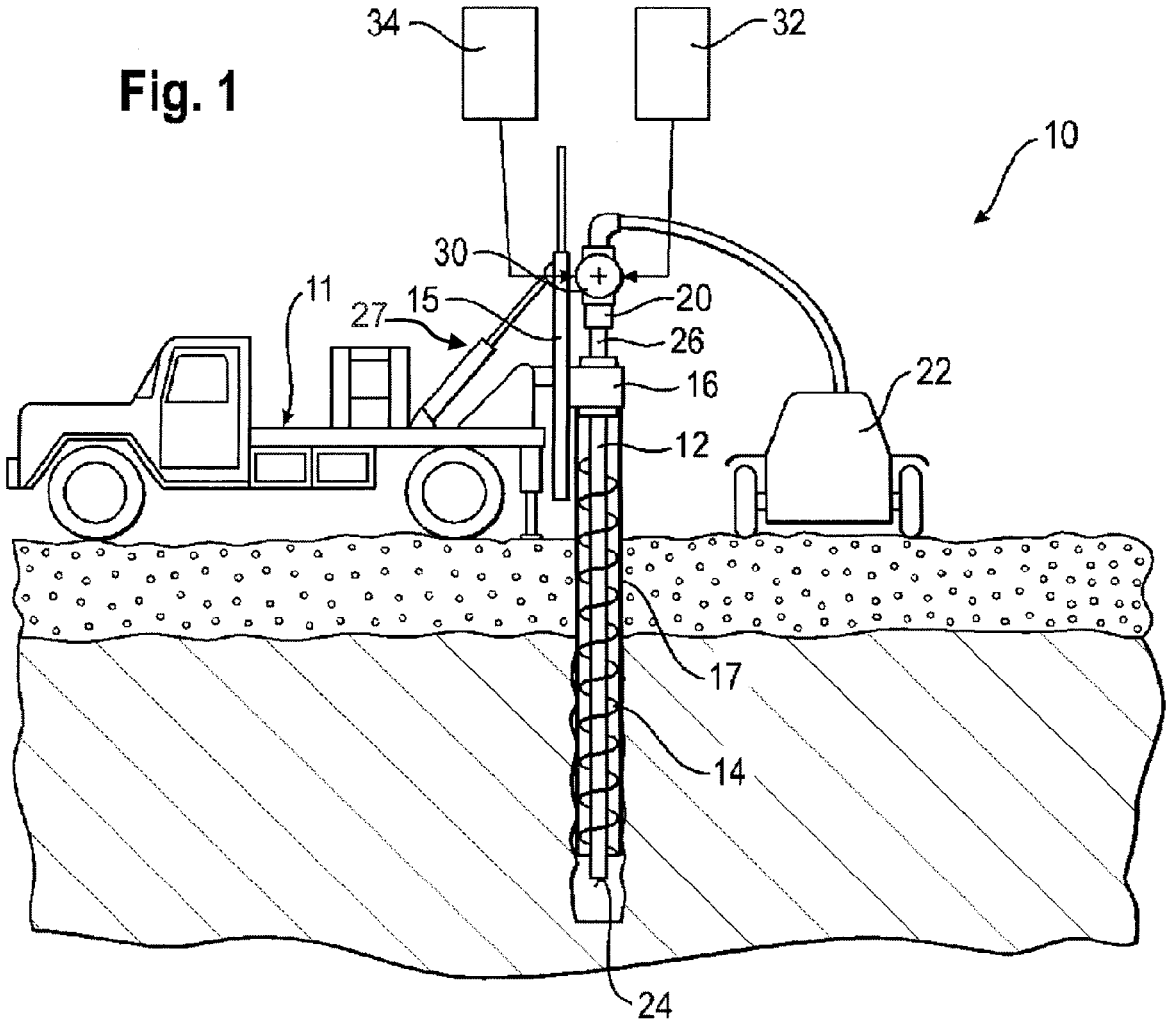
FIG. 1 shows a schematic arrangement of a device for explosive drilling according to the invention.

FIG. 1 shows a device 10 for explosive drilling according to the invention comprising a carrier implement 11, in the rear part of which a vertically directed mast 15 is arranged. Along the mast 15 a tube-shaped drilling body 12 can be displaced vertically by means of a rotary drive 16 in order to sink a borehole in the ground. On the outside of the drilling body 12 an auger 14 is arranged in a known manner, in which case the drilling body 12 is arranged together with the auger 14 again in an encasing tube 17 to carry out cased drilling. Through rotation of the drilling body 12 with the auger 14 stripped soil and rock material can be conveyed away from the borehole.

Above the rotary drive 16 a combining device 30 for the production of explosive capsules is arranged. Via schematically depicted tubes, a powdery or granular fuel made from hydrocarbon molecules or prefabricated capsules containing the fuel are supplied from a container 34. Spaced apart from this container 34 a further container 32 with liquid oxygen is provided, from which liquid oxygen is supplied to the combining device 30 according to demand. In the combining device 30 the solid fuel, if not provided in a prefabricated manner, is formed or configured into the desired capsule shape and is then soaked with the liquid oxygen. In doing so the explosive capsule is activated, which means that only then does the capsule gain its explosive properties. If required, a cooling device can be provided in order to prevent rapid volatilization of the cryogenic liquid oxygen in the combining device 30. The explosive capsule thus produced is supplied immediately from the combining device 30 to a firing device 20 which is operated by means of a pneumatic feeding device 22 with a separate compressor and a pressure line containing compressed air.

By means of a control device not shown here the firing device 20 fires explosive capsules at a rate of approximately 1 Hz through the tube-shaped drilling body 12 in the downward direction at the bottom of the borehole in order to loosen there further soil and rock material. The drilling body 12 driven in a rotating manner is connected through a rotary coupling 26 with the stationary firing device 20. Further, an adjusting device 27 can be provided, with which a selected part of the working face can be fired at for directional control or control of the drilling progress.

Figure 2:
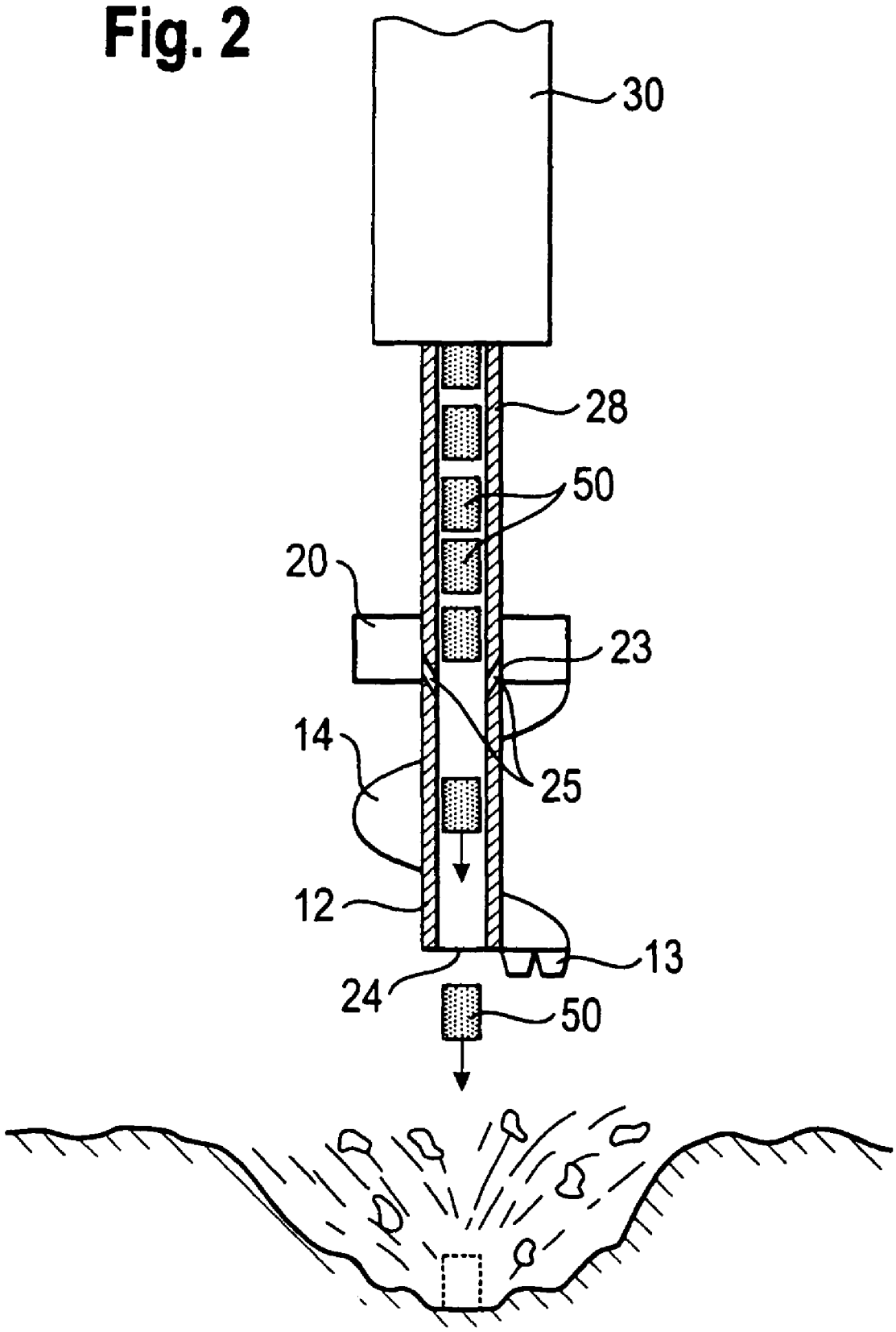
FIG. 2 shows a schematic partially cross-sectional view of a device according to the invention.

In an extremely schematized cross-sectional view according to FIG. 2 the explosive capsules 50 can be seen that are produced in the combining device 30. Through a tube-shaped supply device 28 the explosive capsules 50 are supplied to the firing device 20 that has an annular duct 23 connected to the compressed-air supply. Through nozzle orifices 25 compressed air can be selectively introduced in a ring-shaped manner into the drilling body 12 so as to thereby fire the explosive capsules 50 at a predetermined rate and with a defined kinetic energy from the aperture 24 of the drilling body 12 at the rock material to be shattered. The shattered material can be conveyed away upwards by an auger 14 interacting with stripping members 13 in the shape of cutting teeth located at the lower end of the auger 14.

Figure 3:
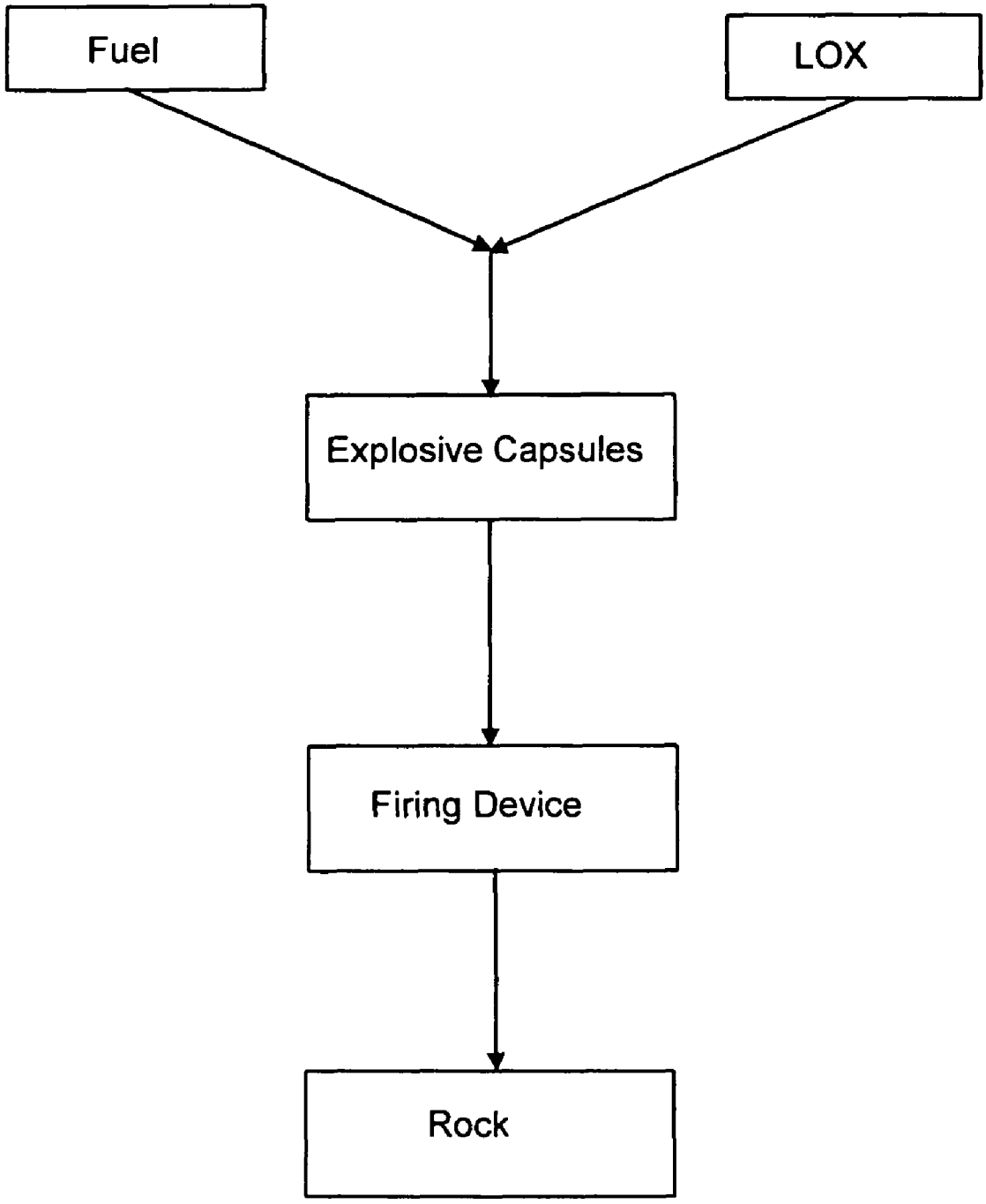
FIG. 3 shows a flow diagram concerning the method for explosive drilling according to the invention.
Figure 3A:
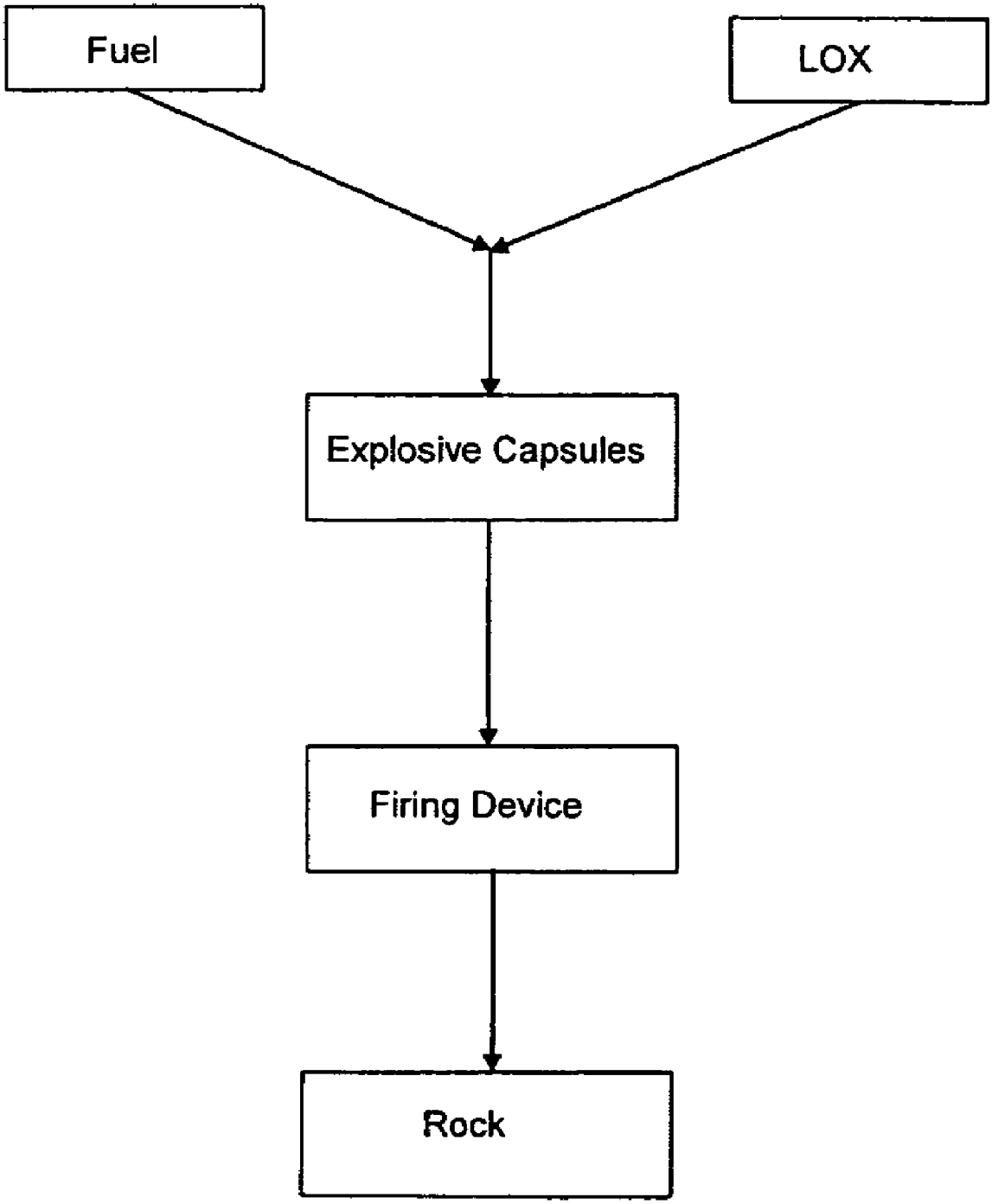
FIG. 3A shows a flow diagram concerning an alternative to the method for explosive drilling according to the invention.

The flow diagram of FIG. 3 illustrates that the explosive capsules are produced by mixing liquid oxygen (LOX) with a powdery and/or granular fuel. As shown in the flow diagram of FIG. 3A, it is possible to fill the fuel component together with the LOX as a kind of slurry into casing bodies. It is only the combination of the fuel with the liquid oxygen that leads to the highly explosive property of the explosive capsules. The explosive capsules are supplied immediately to the firing device, by which the explosive capsules are then fired at the rock to be shattered. Due to the high volatility of liquid oxygen the explosive capsules keep their explosive properties for a short time only so that the safety during explosive drilling is increased. Therefore the produced explosive capsules have to be used rapidly without significant storage and fired immediately by the firing device at the rock.

All things considered, a particularly safe and environmentally compatible explosive drilling is rendered possible according to the invention.

The invention claimed is:

1. A drilling device for explosive drilling, comprising:

at least one container with liquid oxygen therein, at least one container with at least one solid fuel component therein, a combining device for receiving or forming the solid fuel component in the form of shaped bodies and for soaking the solid fuel component with the liquid oxygen to form explosive capsules, a firing device for firing the formed explosive capsules in a defined direction and with a defined energy at a material to be stripped, and a supply device for supplying the formed explosive capsules from the combining device to the firing device.

2. The drilling device according to claim 1, wherein the combining device receives the solid fuel component and at least one of casing bodies, prefabricated capsules containing fuel, and ignition elements to form the explosive capsules.

3. The drilling device according to claim 2, wherein the casing bodies serve as geometric moulds or shape-givers for the explosive charge.

4. The drilling device according to claim 2, wherein the combining device also functions to fill the solid fuel component together with the liquid oxygen as a slurry into the casing bodies.

5. The drilling device according to claim 2, wherein the ignition elements comprise a dynamic inertia plugging provided in the rear part of the explosive capsules as seen in the an impact direction.

6. The drilling device according to claim 1, wherein the device further comprises a tube-shaped drilling body having a lower end portion, and wherein the firing device has at least one aperture, of which is arranged in the lower end portion of the tube-shaped drilling body.

7. The drilling device according to claim 6, further comprising a gas nozzle arrangement in the vicinity of the at least one aperture.

8. The drilling device according to claim 6, further comprising a stripping member in the lower end portion of the drilling body.

9. The drilling device according to claim 8, wherein the stripping member comprises at least one of cutting teeth and roller bits.

10. A method for explosive drilling using the drilling device according to claim 6, comprising the step of:

depending on the angle of rotation of a drill head of the drilling body, firing the explosive capsules at a selected part at the bottom of the borehole, using the firing device.

11. The drilling device according to claim 1, wherein a discharging conveyor device is arranged for conveying away the material to be shattered.

12. The drilling device according to claim 11, wherein the discharging conveyor device is an auger.

13. The drilling device according to claim 1, wherein the firing device includes one of a pneumatic feeding device and a hydraulic feeding device.

14. The drilling device according to claim 1, further comprising an adjusting device for firing at a selected part of the working face for directional control or control of the drilling progress.

15. A method for explosive drilling using the drilling device according to claim 1, comprising the steps of:

using the firing device to fire the formed explosive capsules received by or formed with the combining device, in a defined direction and with a defined energy at a material to be stripped and shattering the material to be stripped by exploding the fired explosive capsules thereon.

16. The method according to claim 15,
further comprising the steps of:
in the combining device, forming the at least one solid fuel component into shaped bodies, and
soaking the at least one solid fuel with the liquid oxygen to form the explosive capsules,
wherein the soaking step can be carried out either before or after the forming step.

17. The method according to claim 16,
wherein
in the forming step, the at least one solid fuel is a powder or granulated material, and the forming step is carried out by sintering or pressing into a desired shape, and
the soaking step is carried out after the forming step.

18. The method according to claim 15,
further comprising the step of:
forming the explosive capsules with the firing device immediately before supplying the explosive capsules to the firing device.

19. The method according to claim 15,
wherein
in the firing step, the explosive capsules are fired by the firing device with a frequency of 1 Hz to 500 Hz.

20. A method for explosive drilling using
the drilling device according to claim 1, comprising firing the explosive capsules in the defined direction and with the defined energy at the material to be stripped, using the firing device.

21. The method according to claim 20, further comprising the steps of:
supplying the combining device with casing bodies and filling the casing bodies with the solid fuel component.

22. The method according to claim 21,
wherein
in the filling step, the casing bodies are filled with the fuel component together with the liquid oxygen as a slurry into the casing bodies.

23. The drilling device according to claim 1,
wherein
the solid fuel component is a powder or granulated material, and
the combining device forms the solid fuel component in the form of shaped bodies by sintering or pressing into a desired shape.

* * * * *